US006382206B1

(12) United States Patent
Palazzotto et al.

(10) Patent No.: US 6,382,206 B1
(45) **Date of Patent: *May 7, 2002**

(54) SPEECH TRANSMISSION ADAPTOR FOR USE WITH A RESPIRATOR MASK

(75) Inventors: Joyce B. Palazzotto, St. Paul; Harold R. Carpenter, Cottage Grove, both of MN (US)

(73) Assignee: 3M Innovative Properties Company, St. Paul, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/940,266

(22) Filed: Sep. 29, 1997

Related U.S. Application Data

(63) Continuation of application No. 08/494,305, filed on Jun. 23, 1995, now abandoned, which is a continuation of application No. 08/130,299, filed on Oct. 1, 1993, now abandoned.

(51) Int. Cl.[7] ..... A62B 18/08

(52) U.S. Cl. ..... 128/201.19; 128/206.12; 128/206.17; 128/201.25

(58) Field of Search ..... 128/201.19, 201.25, 128/202.27, 205.25, 206.12, 206.17

(56) References Cited

U.S. PATENT DOCUMENTS

| | | | | | |
|---|---|---|---|---|---|
| 2,224,057 | A | * | 12/1940 | Mejean | 128/201.19 |
| 2,791,216 | A | * | 5/1957 | Churchill et al. | 128/206.17 |
| 3,142,549 | A | * | 7/1964 | Klusewitz et al. | 128/206.17 |
| 4,072,831 | A | | 2/1978 | Joscelyn | 179/188 |
| 4,111,197 | A | * | 9/1978 | Warncke et al. | 128/202.27 |
| 4,352,353 | A | | 10/1982 | Bolton et al. | 128/201.24 |
| 4,373,520 | A | | 2/1983 | Arbique | 128/201.19 |
| 4,411,264 | A | | 10/1983 | Jabobson | 128/201.23 |
| 4,508,936 | A | | 4/1985 | Ingalls | 179/82 |
| 4,539,983 | A | * | 9/1985 | Angell | 128/201.19 |
| 4,579,113 | A | * | 4/1986 | McCreadle et al. | 128/206.17 |
| 4,595,003 | A | * | 6/1986 | Shoemaker et al. | 128/201.19 |
| 4,627,095 | A | | 12/1986 | Thompson | 381/70 |
| 4,756,308 | A | * | 7/1988 | Ryback | 128/201.19 |
| 4,799,263 | A | | 1/1989 | Banziger et al. | 381/94 |
| 4,873,970 | A | * | 10/1989 | Freidank et al. | 128/205.27 |
| 4,886,058 | A | | 12/1989 | Brostrom et al. | 128/206.12 |

(List continued on next page.)

FOREIGN PATENT DOCUMENTS

| | | | | |
|---|---|---|---|---|
| CA | 1123705 | * | 5/1982 | 128/201.19 |
| WO | WO 92/15369 | | 9/1992 | 128/201.19 |

*Primary Examiner*—Aaron J. Lewis
(74) *Attorney, Agent, or Firm*—Michaele A. Hakamaki

(57) ABSTRACT

A speech transmission adapter and a respirator mask comprising a speech transmission adapter. The respirator mask comprises an inhalation port, an exhalation port, and a speech transmission adapter in detachably sealed engagement with the inhalation port. The adapter comprises a peripheral housing, a speech reception means supported by the peripheral housing, and a speech transmission means operably coupled to the speech reception means. The speech reception means receives sound pressure generated by a wearer of the respirator mask, and the speech transmission means conveys signals representative of such sound pressure to an external speech transducer. The adapter mates to the inhalation port of a respirator mask and expands the clean air envelope defined within the mask to include the speech reception means within the clean air envelope without requiring structural modification of the respirator mask. The speech transmission adapter comprises a central aperture which is adapted to accommodate the passage of air therethrough and engaging means at each of its ends.

14 Claims, 3 Drawing Sheets

U.S. PATENT DOCUMENTS

| | | | | | |
|---|---|---|---|---|---|
| 4,901,356 | A | | 2/1990 | Bauer | 381/169 |
| 4,958,633 | A | | 9/1990 | Angell | 128/201.19 |
| 4,980,926 | A | | 12/1990 | Noetzel | 455/617 |
| 4,989,596 | A | | 2/1991 | Macris et al. | 128/201.28 |
| 4,997,217 | A | * | 3/1991 | Kunze | 128/202.27 |
| 5,069,205 | A | * | 12/1991 | Urso | 128/206.17 |
| 5,101,816 | A | * | 4/1992 | Wilcox | 128/202.27 |
| 5,103,815 | A | | 4/1992 | Siegel et al. | 128/205.23 |
| 5,138,666 | A | | 8/1992 | Bauer et al. | 381/169 |
| 5,199,424 | A | | 4/1993 | Sullivan et al. | 128/204.21 |
| 5,224,473 | A | | 7/1993 | Bloomfield | 128/201.19 |
| 5,224,474 | A | | 7/1993 | Bloomfield | 128/201.19 |
| 5,463,693 | A | | 10/1995 | Birli et al. | 381/75 |
| 5,562,092 | A | * | 10/1996 | George | 128/201.25 |

* cited by examiner

SPEECH TRANSMISSION ADAPTOR FOR USE WITH A RESPIRATOR MASK

This is a continuation of application Ser. No. 08/494,305 filed Jun. 23, 1995, now abandoned which is a continuation of application Ser. No. 08/130,299 filed on Oct. 1, 1993, now abandoned.

TECHNICAL FIELD

The present invention relates to a speech transmission adapter for use with both full facepiece and partial facepiece respirator masks. More particularly, the invention relates to a speech transmission adapter that is contained within the clean air envelope that is defined by the mask and the face of the wearer, but does not require penetration of the mask structure.

BACKGROUND OF THE INVENTION

Respirator masks are used in a wide variety of hazardous environments. Such environments include paint booths, grain storage facilities, laboratories with hazardous biological materials and environments containing certain chemical fumes. Respirator masks are typically adapted to receive a variety of filter units and other attachments that are designed specifically for the hazardous environment in which the mask is to be used. As such, the same mask body can be used in a variety of different hazardous environments simply by changing the filter. This ease of changing filters makes the masks very cost effective by permitting the manufacture of a single mask for multiple environments.

Respirator masks define a clean air envelope with the face of the wearer. The clean air envelope includes the clean air source and is bounded by the mask, the mask's seal with the face of the wearer, and the exhalation valve of the mask.

There are two general designs of respirator face masks: the partial facepiece mask and the full facepiece mask. A partial facepiece mask typically encloses the wearer's mouth and nose and forms a seal with the portion of the wearer's face that is contiguous to the nose and mouth. The eyes are left unprotected when using the partial facepiece mask. The full facepiece mask is a much larger unit and encloses the wearer's eyes in addition to the wearer's nose and mouth. Such masks include a transparent viewing portion to permit the wearer to see while wearing the mask.

Respirator masks can additionally be distinguished by being either a positive pressure or negative pressure device. A positive pressure device typically includes an external pump or pressurized vessel, with or without a filter, that is the clean air source and that forces air into the mask. Such a mask creates a more positively sealed clean air envelope about the wearer since the internal pressure in the clean air envelope created by the mask and the wearer's face is at a higher pressure than the environment around the mask. In this case, environmental air is not allowed to seep into the clean air envelope because it is restrained by the higher pressure inside the clean air envelope.

A negative pressure respirator mask functions on the negative pressure generated by the wearer inhaling. The inhalation generates a negative pressure inside the clean air envelope and draws air into the respirator mask. Generally, ambient air is drawn through a filter or filters by the negative pressure. The filters clean the air and the air is then drawn into the clean air envelope of the mask for inhalation by the wearer.

In the past, there has been substantial work performed in attempting to provide a means for the wearer of a breathing apparatus to communicate orally. Inactive devices are purely mechanical devices and active devices involve some form of enhancement by powered amplification. The most common inactive communication device is the voice diaphragm. This is a sealing diaphragm that is designed to vibrate in response to the pressure waves in the mask that are generated by the wearer's speech The prior art comprises two general categories of active speech transmission devices: internal devices and external devices. Internal devices are typically constructed integral to the mask itself. Such devices comprise microphones, light transmission, and magnetic transmission devices. The devices are mounted within the clean air envelope defined between the mask and the wearer's face. A desirable feature of the internally mounted devices is that they, in general, provide a louder volume and truer, more distinct reproduction of the speech of the wearer when compared to the externally mounted devices.

The internally mounted voice receivers generally require structural modification of the mask itself to mount the device within the mask. The devices typically require penetration of the mask to transmit the wearer's voice outside of the clean air envelope, involving further modification of the mask structure. This penetration is not necessarily a drawback where the voice transmission is required to be used in all cases when the mask is worn. Such instances include, for example, masks worn by the operators of high performance aircraft and masks worn by fire fighters. Structural modification and physical penetration of the mask are a distinct disadvantage in instances where the speech transmission is desired to be an optional feature to an existing mask design.

The active external devices are mounted outside the clean air envelope defined by the mask. Such devices typically have poorer quality sound transmission since the sound energy must penetrate a voice diaphragm or the like before being received by the speech transmission device. Such devices do not however penetrate the clean air envelope of the mask. These devices typically involve the use of transducers attached to the exterior of the mask to amplify the sound that is transmitted through a voice diaphragm. The diaphragm is a gas tight seal and may be a vibrating voice diaphragm or may be the exhalation diaphragm of the mask. Such external devices have the advantage that they can be designed to readily added to existing masks by clip-on features and the like and thus may not require structural modification of the mask itself.

Examples of internally mounted active speech amplification units are typified by the devices of U.S. Pat. Nos. 4,989,596 and 4,980,926, and one embodiment of U.S. Pat. No. 4,508,936. Externally mounted speech transmission adapters are exemplified by the devices of U.S. Pat. Nos. 4,352,353, 5,138,666, 5,224,473, and 5,224,474.

It would be a decided advantage to have an enhanced speech transmission device that is readily adaptable to be attached to an existing mask that is produced in large quantities. The speech transmission adapter should produce excellent quality voice transmission. This requirement means that the adapter should be mounted inside the clean air envelope defined by the mask on the wearer's face. In order to minimize the cost impact of the adapter, it is highly desirable that the design not require any structural modifications to the basic respiratory mask as it is produced without an enhanced voice transmission device.

SUMMARY OF THE INVENTION

The present invention is a speech transmission adapter designed to be optionally included with existing respirator masks that do not have an active speech enhancing transmission capability. The adapter of the present invention expands the clean air envelope defined within the mask, placing the speech reception device within the clean air envelope in order to capture the high quality sound available within the envelope. The adapter accomplishes this without structural modification to the mask or penetration of the mask body.

Briefly, the present invention is a speech transmission adapter for use with a respirator mask in receiving the sound pressure generated by the speech of a wearer of the respirator mask. The respirator mask is designed to be worn in sealing engagement with a portion of the face of the wearer of the respirator mask (also commonly known as a protective respirator) and has a compliant body that includes at least one inhalation port through which clean air is admitted to the respirator mask and a clean air source coupled to the inhalation port. The mask further includes an exhalation port through which exhaled air is expelled from the mask and a sealing portion generally at the periphery of the respirator mask that is held in sealing engagement with the face of the wearer. The respirator mask defines a clean air envelope between the body of the respirator mask and the face of the wearer bounded by the sealing portion of the respirator mask, the clean air source and the exhalation port. The speech transmission adapter includes a peripheral housing which functions as a 'spacer' between an inhalation port and an air filter otherwise attached thereto, and a speech receiver supported by the peripheral housing that is in communication with the sound pressure generated by the speech of the wearer of the respirator mask for receiving such sound pressure. A speech transmission device is connected to the speech receiver and adapted to be coupled to an external speech transducer for conveying signals representative of the received speech energy to the external speech transducer. The peripheral housing is adapted to mate to the respirator mask in a manner that expands the clean air envelope defined therein to include the speech reception device within the clean air envelope without requiring structural modification to the respirator mask.

DETAILED DESCRIPTION OF THE INVENTION

In the Figures, similar features have been given similar reference numbers.

Figure 1:
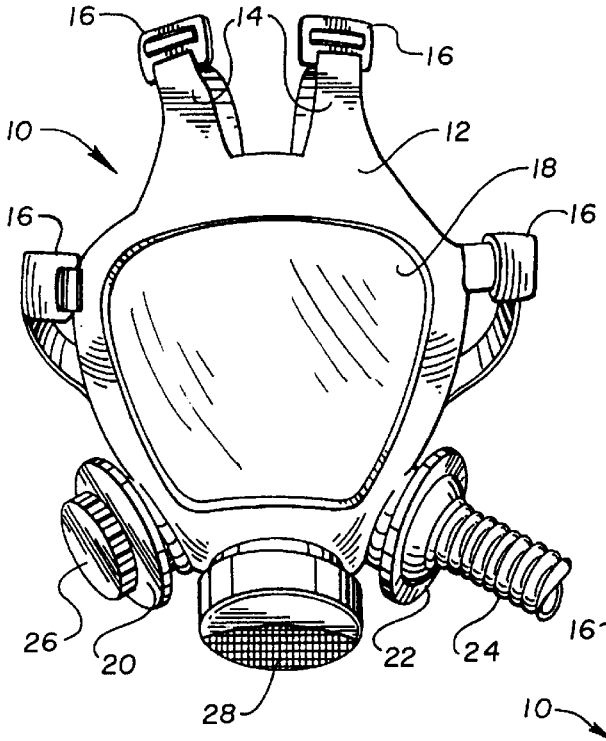
Fig.1 PRIOR ART
FIG. 1 is a perspective view of a prior art full facepiece respirator.

Referring first to FIG. 1, there is shown a prior art full facepiece respirator mask 10. Mask 10 has a rubberized body 12 that is adapted to enclose the wearer's eyes, nose, and mouth. Body 12 is designed to form a seal at its periphery with the face of the wearer. Special sealing material may be attached proximate the periphery of body 12 to contact the skin of the wearer to form a better seal therewith. Body 12 is formed of a material that is selected to be substantially impermeable to the types of airborne environmental hazards that mask 10 is designed to offer a barrier to.

A series of cooperative straps 14 are affixed to mask 10 to provide a means by which the wearer is able to forcibly bring mask 10 into contact with the wearer's face to effect a seal therewith. Straps 14 may be elasticized to ensure a continuing seal, notwithstanding movement of the wearer.

In the embodiment shown, straps 14 include slip clamps 16. Slip clamps 16 have a toothed portion that is oriented such that the toothed portion bears on the strap 14 in a directional manner and thereby limits motion of strap 14 with respect to clamp 16 that would tend to loosen the fit of mask 10. The toothed portion of slip clamp 16 is so oriented to permit strap 14 to be readily drawn through slip clamp 16 in the direction that tightens mask 10 to the face of the wearer.

A single transparent facepiece 18 is provided in mask 10. In an alternative embodiment, two individual eye pieces are provided in the front of the mask 10 corresponding to the visional ranges of each of the wearer's eyes. Facepiece 18 and the alternative eyepieces are preferably formed of a clear, non-permeable, shock resistant, plastic material in order to provide a good seal and to afford some protection to the wearer's eyes.

Mask 10 is provided with two inhalation ports 20, 22. Inhalation ports 20, 22 typically have a periphery formed of a circular hard plastic material and are adapted to receive a variety of interchangeable devices that affect the clean air within the mask 10. In the embodiment shown, inhalation port 22 is connected to positive pressure line 24. Positive pressure line 24 is in turn connected to a pump or a pressurized vessel (not shown) that may include a filter. Such pump or pressurized vessel is a source of clean air and provides the clean air under pressure to mask 10. In this embodiment, mask 10 is a positive pressure device having a higher pressure inside the clean air envelope of the mask 10 than the ambient pressure outside the mask 10. In this configuration, inhalation port 20 is sealably closed by means of a sealing insert 26 that is detachably affixed to inhalation port 20. Insert 26 may be attached by a threaded engagement therewith, by the use of bayonet fittings, or by like devices that provide for ready sealing and unsealing.

Mask 10 further includes an exhalation port 28. Exhalation port 28 is typically formed of a hard plastic material and has structure defining an aperture therethrough. A flexible diaphragm (not shown) is inserted in the aperture and opens responsive to an increase in pressure in the clean air envelop of the mask. The diaphragm that is positioned in exhalation port 28 is biased to be self-sealing and thereby creates a gaseous seal that helps establish the clean air envelope within the mask. The diaphragm prevents ambient air from entering the mask 10 when it is closed and the expelling of exhaled air prevents ambient air from entering the mask during the periods that the diaphragm is open.

As previously indicated, mask 10 defines a clean air envelope around the wearer's eyes, nose, and mouth within the body 12 of mask 10. The clean air envelope is defined by the body 12 (including facepiece 18) of mask 10, the seal at the edges of mask 10 and the face of the wearer, the sealing insert 26 in inhalation port 20, positive pressure line 24 at inhalation port 22, and exhalation port 28. It is within the clean air envelope as just described that the speech energy of the wearer is best received for clarity of annunciation and volume.

Figure 2:
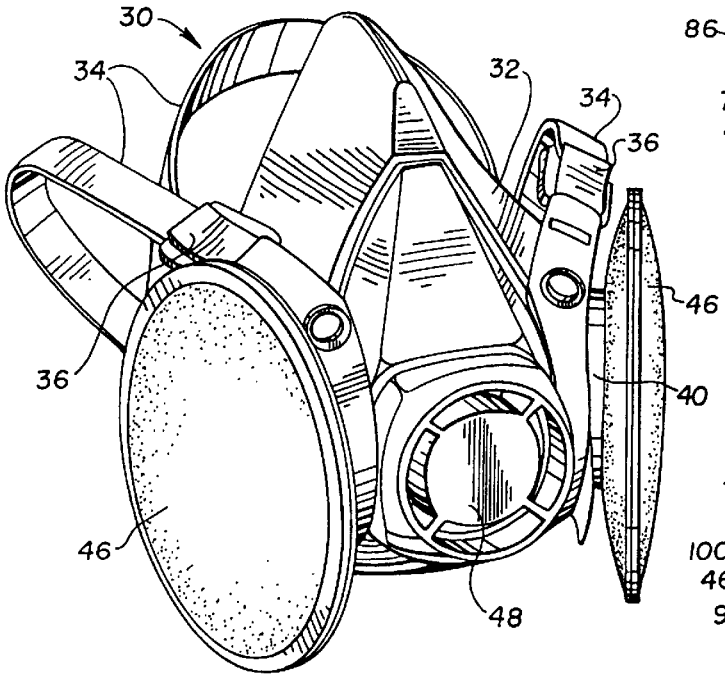
Fig. 2 PRIOR ART
FIG. 2 is a perspective view of a prior art partial facepiece respirator.

Referring now to FIG. 2, there is shown a partial facepiece respirator mask 30. Mask 30 includes a flexible body 32 that is preferably rubberized. The body 32 is designed to conform to the face of the wearer and to sealingly enclose the wearer's nose and mouth. Portions of body 32 may be constructed of a relatively more resilient material in order to provide a more rigid shape and supporting structure to body 32. Body 32 is constructed of materials that are selected to be essentially impermeable to the hazardous materials in the environment in which mask 30 is expected to be used.

Mask 30 includes elasticized straps 34 designed to be worn around the wearer's head. Straps 34 include buckles 36. In this embodiment, buckles 36 include an over-centered device with a tang designed to exert a clamping force on straps 34. The wearer is able to pull straps 34 to a snug position creating an effective seal between mask 30 and the wearer's face. When straps 34 are snug, the over-center device of buckle 36 is rotated such that the tang bears firmly against strap 34 and a back plate of buckle 36. Since the device has an over-center feature, the tang is held in the closed position grasping strap 34 and resisting the movement of strap 34 through buckle 36 in the direction tending to loosen strap 34.

Figure 4:
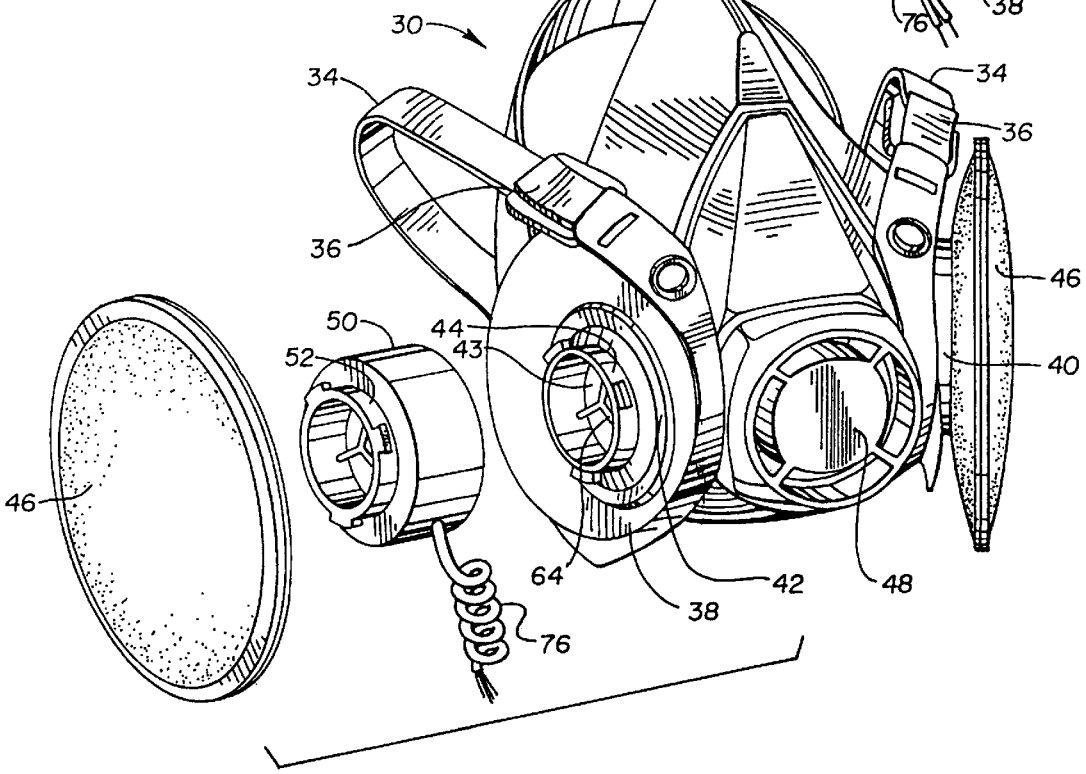
FIG. 4 is a perspective view of the respirator depicted in FIG. 2 and including the sound transmission adapter broken out and interposed between the air filter and the inhalation port of the respirator.

Two inhalation ports 38, 40 are included in mask 30. Inhalation port 38 is depicted in FIG. 4. The structure of inhalation port 40 is generally the same as inhalation port 38 and inhalation ports 20, 22, depicted in FIG. 1, are of similar construction as inhalation ports 38, 40. Referreing to FIG. 4, inhalation port 38 has a peripheral housing 42 that is preferably formed of a hard plastic material to provide a relatively non-deformable structure to inhalation port 38. Aperture 43 is formed central to peripheral housing 42 to accommodate the passage of clean air therethrough.

Inhalation port 38 is designed for the ready attachment and detachment of mating devices thereto. Accordingly, inhalation port 38 has attaching point 44 included generally peripheral to aperture 43. Attaching point 44 is more fully described in conjunction with FIGS. 5 and 6 and may be a bayonet fitting, a threaded connector, a press fit connector, or the like.

Referring again to FIG. 2, filters 46 are adapted to be readily attached to and detached from inhalation ports 38, 40. The design of the attaching points (not shown) is such that the filters 46 may be readily replaced in the field without special tools or training when the filters no longer perform their desired function by readily mating with attaching point 44 (FIG. 4) of inhalation ports 38, 40. Filters 46 come in a variety of shapes to accommodate various types of filtering material. In some instances, the attaching points are designed to ensure a particular desired orientation of the filter 46 with respect to the mask 30 when filter 46 is installed. By the simple expedient of changing the filters 46, mask 30 is readily adaptable to a number of different hazardous environments.

The previously described inhalation ports 20, 22 depicted in FIG. 1 are designed similarly to inhalation ports 38, 40. Accordingly, filters 46 shown in conjunction with mask 30 are readily utilized with mask 10 shown in FIG. 1. In order to utilize filters 46 with mask 10, positive pressure line 24 is simply turned, released, and withdrawn from inhalation port 22 and sealing insert 26 is turned, released, and withdrawn from inhalation port 20. Such action prepares inhalation ports 20, 22 to receive filters 46. The installation of filters 46 on mask 10 converts mask 10 from a positive pressure device to a negative pressure device. A negative pressure respirator mask functions on the negative pressure generated by the wearer's act of inhaling. Negative pressure generated within the clean air envelope formed by the mask 10 would draw air through filters 46 and into the mask 10 through the inhalation ports 20, 22. It can be seen from this description of the pressure functioning of mask 10 that mask 30 shown in FIG. 2 is also a negative pressure device and relies upon the inhalation of the wearer to generate clean air flow through filters 46 and into the mask through inhalation ports 38, 40.

As shown in FIG. 2, mask 30 also includes an exhalation port 48. Exhalation port 48 includes a diaphragm (not shown) that is biased in the closed position, thereby creating a seal between the interior of mask 30 and the environment surrounding it. The diaphragm of exhalation port 48 is unseated and opened by the increased pressure within the clean air envelope defined by mask 30 that is generated by the wearer during exhalation. Once unseated, the diaphragm of exhalation port 48 permits the expulsion of exhaled air from the clean air envelope defined by mask 30.

The clean air envelope created by mask 30 is defined by body 32 of mask 30, the seal formed at the periphery of mask 30 with the face of the wearer, the filters 46, and the exhalation port 48.

Figure 3:
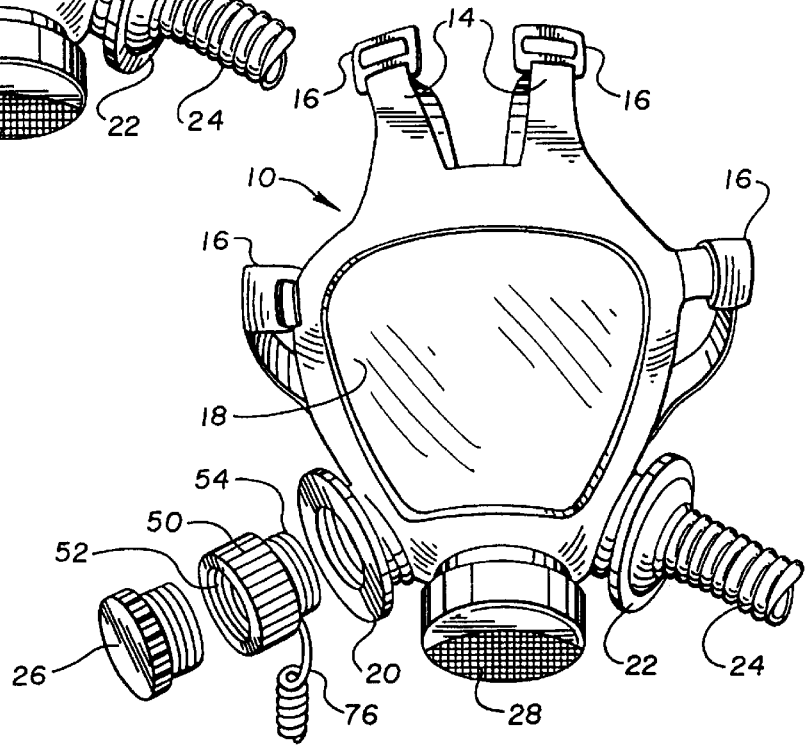
FIG. 3 is a perspective view of the respirator depicted in FIG. 1 and including the sound transmission adapter broken out.

FIG. 3 shows the full facepiece respirator mask 10 utilized with a speech transmission adapter 50 of the present invention. Adapter 50 is formed to mirror the attaching points of inhalation port 20 and sealing insert 26. As is readily apparent from FIG. 3, adaptor 50 functions as a spacer for separating the inhalation port 20 and the filter 46 by providing a body with a passage extending the entire length thereof through which filtered air may pass from the filter to the inhalation port. Accordingly, speech adapter 50 has a first attaching point 52 that is formed with identical engaging members to that of sealing insert 26. Speech transmission adapter 50 has a second attaching point 54 that is formed with identical engaging members to those of the attaching point of inhalation ports 20, 22. In the depicted embodiment, the second attaching point 54 has threads that are designed to cooperatively engage the threads of inhalation port 20. First attaching point 52 has threads that are designed to cooperatively engage the threads of sealing insert 26. In this manner, speech transmission adapter 50 can be mated to mask 10 simply by mating second attaching point 54 to inhalation port 20 and then by mating first attaching point 52 either to sealing insert 26 or filter 46, as the case may be.

The effect of the above described action is to expand the clean air envelope that is created by mask 10 to include the spacer or speech transmission adapter 50 without making any structural modifications to mask 10. This unique design accomplishes the goal of placing the microphone within the clean air envelope where quality sound production is possible and at the same time accomplishing this without any structural modification to the mask 10 itself.

FIG. 4 illustrates the same functionality of the speech transmission adapter 50 when utilized in conjunction with mask 30. In the embodiment depicted, the first and second attaching points 52, 54 (see FIG. 5) of speech transmission adapter 50 are bayonet fittings that are designed to cooperatively engage cooperatively designed bayonet fittings of filter 46 and inhalation port 38. The engaging structure of first and second attaching points 52, 54 is more fully described in conjunction with the description of FIG. 5. The same speech transmission adapter 50 is designed to be readily utilized with either mask 10 or mask 30. In both cases, the speech transmission adapter 50 may be readily utilized with the mask 10, 30 in the field to convert the mask 10, 30 to have an enhanced speech transmission capability.

Figure 5:
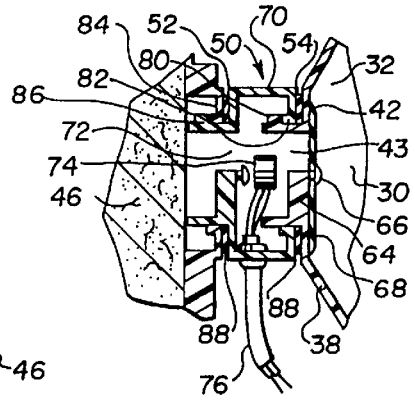
FIG. 5 is a sectional view showing the sound transmission adapter utilizing bayonet type attachment devices.

FIG. 5 depicts the speech transmission adapter 50 configured with bayonet type fittings. The depicted embodiment may be utilized with either the full facepiece mask 10 or the partial facepiece mask 30. For ease of understanding, only the reference numbers of the partial facepiece mask 30 are included. The body 32 of mask 30 is depicted in sealing engagement with the inhalation port 38. Inhalation port 38 includes a peripheral housing 42. The housing 42 is preferably formed of a substantially resilient plastic material in order that the housing 42 is resistant to deformation under conditions of normal use. Housing 42 has structure defining a central aperture 43 therethrough that accommodates the passage of air through inhalation port 38.

Spiders 64 emanate inward into aperture 43 from the peripheral housing 42, culminating at a central hub 66. The central hub 66 includes an inwardly directed post that provides an attachment point for inhalation diaphragm 68. In a preferred embodiment there are three such spiders 64 supporting hub 66. The spiders 64 have a relatively thin cross section so as to minimize the resistance to air flow in aperture 43 presented by spiders 64.

Inhalation diaphragm 68 has a larger diameter than aperture 43 such that the periphery of diaphragm 68 extends beyond aperture 43 to sealingly engage housing 42. The negative pressure in the clean air envelope generated by the wearer's act of inhalation draws the periphery of diaphragm 68 away from housing 42 to create an opening and to admit air into the clean air envelope. Diaphragm 68 functions to prevent exhalation through filter 46. Diaphragm 68 closes upon the act of exhalation by the wearer responsive to the increased pressure within the mask that is generated by the act of exhalation. Under other conditions, diaphragm 68 may be open. In positive pressure units, a diaphragm 68 may not be utilized since the positive incoming pressure acts to prevent exhalation to the clean air source. Diaphragm 68 is generally formed of a thin, highly flexible material.

Speech transmission adapter 50 is depicted in registry with inhalation port 38 and disposed exterior thereto. Speech transmission adapter 50 has a peripheral housing 70 that is formed of a plastic material having similar properties to the plastic utilized to form housing 42 of inhalation port 38. Peripheral housing 70 has a central aperture 72 that is in registry with central aperture 43 of inhalation port 38.

A speech reception device 74 is installed within aperture 72. In a preferred embodiment, speech reception device 74 is an electromagnetic microphone. As depicted in FIG. 5, the microphone 74 extends from the peripheral housing 70 of the spacer or speech transmission adapter 50, but not into the interior space of the face mask. Other types of known speech reception devices may also be used. In the depicted embodiment, leads 76 pass through a small bore (not shown) in peripheral housing 70 and are held in place by cement or the like. Alternatively, leads 76 may be brought through housing 70 by being press fit into a slot formed in housing 70. In another embodiment, quick-disconnect connectors (not shown) of a conventional design are provided to facilitate the ready disconnecting of the leads 76.

Leads 76 are typically connected to a transducer such as a pocket or belt mounted speech amplifier/ speaker or are connected into an existing intercom system utilized by several workers on a job. Leads 76 convey the received voice energy of the wearer from speech reception device 74 to the transducer.

Speech transmission adapter 50 is connected to inhalation port 38 by means of bayonet fittings. Generally, bayonet fittings comprise cooperating opposed slots and hooks. The hooks are inserted into the slots of the opposing device and then the devices are rotated a slight amount with respect to one another to engage the hooks. Slight inward pressure and rotation in the opposite direction readily disengages the opposed hooks. Accordingly, as applied to the present invention, hooks 80 formed on housing 42 of inhalation port 38 engage hooks 82 formed on peripheral housing 70 of speech transmission adapter 50.

Filter 46 is attached to the side of speech transmission adapter 50 that is opposed to mask 30. Attachment is by similar bayonet fittings as described above. The hooks 84 of the filter 46 are designed to cooperatively engage the hooks 86 of speech transmission adapter 50. Hooks 84 are also designed to cooperatively engage the hooks 80 formed on housing 42 of inhalation port 38 such that filter 46 may as readily be utilized with mask 30 alone or with mask 30 incorporating speech transmission adapter 50.

Seals 88 are disposed between inhalation port 38 and speech transmission adapter 50 and between speech transmission adapter 50 and filter 46 to extend the clean air envelope to the filter 46 when speech transmission adapter 50 is utilized. Clean air then flows from filter 46 through aperture 72 in speech transmission adapter 50 and through aperture 43 in inhalation port 38 to the interior of mask 30 and to the wearer.

Figure 6:
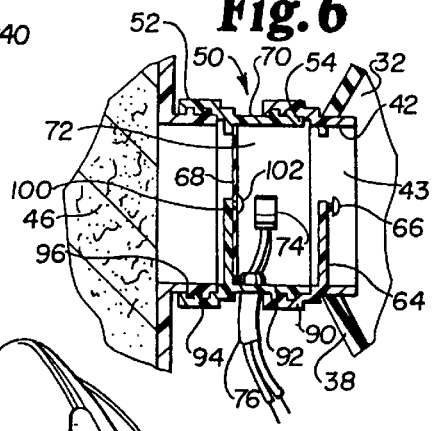
FIG. 6 is a sectional view showing the sound transmission adapter utilizing threaded type attachment devices.

In FIG. 6 the depicted embodiment is similar to the structure depicted in FIG. 5 with two exceptions. Instead of the bayonet fittings depicted in FIG. 5, this embodiment utilizes threaded fittings and the inhalation diaphragm 68 is disposed within speech transmission adapter 50 as opposed to being within inhalation port 38.

Female threads 90 are formed integral to the structure of inhalation port 38. Cooperating male threads 92 are formed integral to the structure of speech transmission adapter 50. In the opposing side of speech transmission adapter 50 female threads 94 are formed integral to the structure of speech transmission adapter 50. Cooperating male threads 96 are formed integral to the structure of filter 46. Appropriate seals such as gaskets or 0 rings may be incorporated in order to ensure an effective seal at the threaded joints. It can be seen that the male threads 92, 96 and female threads 90, 94 are selected such that the filter 46 is capable of being connected directly to inhalation port 38 without structural modification when speech transmission adapter 50 is not utilized in conjunction with mask 30. Likewise, the installation of speech transmission adapter 50 between filter 46 and inhalation port 38 requires no structural modification to either filter 46 or inhalation port 38.

Diaphragm 68 is depicted supported by spiders 100 and a supporting hub 102. Spiders 100 and supporting hub 102 are preferably formed substantially identical to spiders 64 and a supporting hub 66 so that the position of diaphragm 68 may be readily changed without alteration of diaphragm 68. The depicted positioning for inhalation diaphragm 68 within speech transmission adapter 50 is illustrative of the fact that incorporating speech transmission adapter 50 with mask 30 expands the boundary of the clean air envelope. It has been found that this location for inhalation diaphragm 68 enhances the quality of the sound as compared to the embodiment in FIG. 5.

Figure 7:
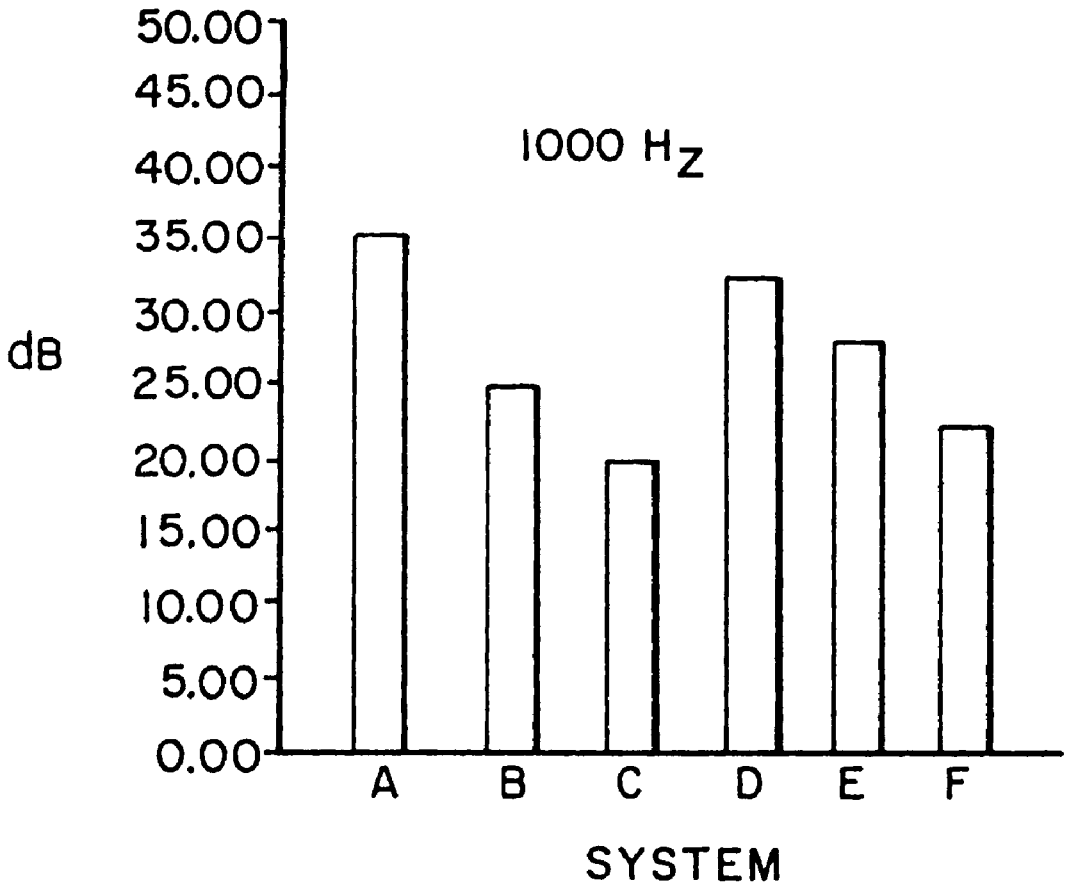
FIG. 7 is a chart depicting the attenuation of sound with various respirator configurations.

FIG. 7 is a graph of sound pressure attenuation that serves to illustrate sound attenuation with three different configurations of microphones on two different masks. The frequency response of the mask speaker system was measured using the cross spectrum method in an anechoic chamber. A 0.5" random field microphone was used for the source measurement; a 0.5" free field microphone was used for the reception measurement at 0.9 meters from the source. Analysis utilized a B&K 2144 real time analyzer, ⅓ octave band, in the cross spectrum mode. The frequency response was calculated by the following equation:

$$\log H = \log G_{xy} - \log G_{xx} \text{ where}$$

$\log G_{xy}$=measured cross spectra of source and received signal, and $\log G_{xx}$=Auto Spectra of source as measured by the random field microphone.

The attenuation is shown in units of dB of attenuation. Accordingly, the less dB attenuation in a given configuration, the more sound that is available and the more desirable that particular system is. It should be noted that a 3 dB loss is roughly equivalent to a twofold sound energy loss. The data were taken in an anechoic chamber at 1000 Hz for both the partial facepiece mask and the full facepiece mask. Systems A, B, and C are full facepiece masks and Systems D, E, and F are partial facepiece masks. Systems A and D are representative of the prior art and are a design that includes a microphone mounted exterior to the mask. The present invention is represented by Systems B, C, E, and F. Systems B and E have the inhalation valve mounted as depicted in FIG. 5. Systems C and F have the inhalation valve mounted in the speech transmission adapter and external to the microphone as depicted in FIG. 6.

It can be seen that the prior art device when used with both the full and partial facepiece masks results in substantially greater attenuation than any of the configurations of the present invention. The inner diaphragm configuration of the present invention, Systems B and E, shows a substantial improvement in sound energy transmission over the prior art, while the outer diaphragm configuration of the present invention as depicted by Systems C and F provides the greatest improvement.

The present invention has now been described with reference to several embodiments thereof. It will be apparent to those skilled in the art that many changes can be made in the embodiments described without departing from the scope of the present invention. Thus, the scope of the present invention should not be limited to the structures described herein, but rather by the structures described by the language of the claims and the equivalents of those structures.

We claim:

1. A negative pressure respirator mask defining a clean air envelope at least around a wearer's nose and mouth comprising:

a) a compliant body having a peripheral sealing portion, said sealing portion being adapted to be worn on a wearer's face in sealing engagement therewith;

b) an inhalation port for admitting clean air to the negative pressure respirator mask;

c) a filter element that can be detachably secured to the negative pressure respirator mask such that inhaled air that passes through the inhalation port first passes through the filter element;

d) an exhalation port separate from the inhalation port for expelling exhaled air from the negative pressure respirator mask; and e) a speech transmission adapter that is in detachably sealed engagement with the inhalation port, the adapter comprising:

i) a peripheral housing and a central aperture extending through the peripheral housing, the central aperture being adapted for accommodating the passage of air therethrough;

ii) a speech reception means for receiving sound pressure generated by a wearer of the negative pressure respirator mask, supported by the peripheral housing and being exterior of the compliant body; and iii) a speech transmission means for conveying signals representative of any sound pressure received by the speech reception means to an external speech transducer and being operably coupled to the speech reception means; wherein the filter element can be detachably secured to the negative pressure respirator mask by being connected to either the speech transmission adapter or the inhalation port.

2. The negative pressure respirator mask of claim 1, wherein the adapter mates to the inhalation port and expands a clean air envelope defined within the negative pressure respirator mask to include the speech reception means within the clean air envelope without requiring structural modifications of the negative pressure respirator mask.

3. The negative pressure respirator mask of claim 1, wherein the inhalation port comprises a first engaging means and the adapter comprises a second engaging means detachably mates with the first engaging means.

4. The negative pressure respirator mask of claim 1, wherein the adapter comprises a central aperture extending through its peripheral housing, the peripheral housing comprising a structure supporting an inhalation valve, the inhalation valve being disposed outwardly of the speech reception means so that the speech reception means is disposed between the inhalation valve and a wearer during use of the negative pressure respirator mask.

5. The negative pressure respirator mask of claim 1, wherein the speech reception means comprises a microphone.

6. The negative pressure respirator mask of claim 1, further comprising a sealing plug that is in detachably sealed engagement with the adapter.

7. The negative pressure respirator mask of claim 6, further comprising a second inhalation port and a positive pressure conduit line that is in sealed engagement with the second inhalation port, the positive pressure conduit line being adapted to transport clean air to the negative pressure respirator mask through the second inhalation port.

8. The negative pressure respirator mask of claim 1, further comprising a positive pressure conduit line that is in detachably sealed engagement with the adapter, the adapter being disposed between the inhalation port and the positive pressure conduit line, the positive pressure conduit line being adapted to transport clean air to the negative pressure respirator mask through the adapter and the inhalation port.

9. The negative pressure respirator mask of claim 8, wherein the inhalation port comprises a first engaging apparatus and a first sealing apparatus, the positive pressure conduit line comprises a second engaging apparatus and a second sealing apparatus, the second engaging apparatus being adapted for detachably engaging with the first engaging apparatus, the second sealing apparatus being adapted for cooperating engagement with the first sealing apparatus, and the adapter comprises an engaging apparatus that is substantially identical to the second engaging apparatus, the adapter engaging apparatus being in detachably sealed engagement with the first engaging apparatus.

10. The negative pressure respirator mask of claim 1 further comprising an air filter which is in detachably sealed engagement with the adapter, the peripheral housing of the adapter comprising a central aperture that is adapted for accommodating the passage of air therethrough.

11. The negative pressure respirator mask of claim 10 wherein the inhalation port comprises a first engaging apparatus and a first sealing apparatus, the air filter comprises a second engaging apparatus and a second sealing apparatus, the second engaging apparatus being adapted for detachably engaging with the first engaging apparatus, the second sealing apparatus being adapted for cooperating engagement with the first sealing apparatus, and the adapter comprises an engaging apparatus that is substantially identical to the second engaging apparatus, the adapter engaging apparatus being in detachably sealed engagement with the first engaging apparatus.

12. A speech transmission adaptor that is adapted to be used with a negative pressure respirator mask, the adaptor comprising:

a) a peripheral housing and a central aperture extending through said peripheral housing, the central aperture being adapted for accommodating the passage of air therethrough;

b) a speech reception means for receiving sound pressure supported by the peripheral housing;

c) a speech transmission means for conveying signals representative of any sound pressure received by the speech reception means to an external speech transducer and operably coupled to the speech reception means; and d) engaging apparatus at each end of the adaptor to detachably mate to a negative pressure respirator mask and to a filter element, the adaptor being capable of expanding a clean air envelope defined within the mask to include the speech reception means within the clean air envelope without requiring structural modification of a negative pressure respirator mask.

13. The adapter of claim 12, wherein the peripheral housing comprises a structure supporting an inhalation valve, the inhalation valve being disposed in the adaptor such that the speech reception means is located between the inhalation valve and a wearer during use of a negative pressure respirator mask.

14. The adapter of claim 12 wherein said speech reception means comprises a microphone.

* * * * *